US006531961B2

(12) United States Patent
Matsudaira

(10) Patent No.: US 6,531,961 B2
(45) Date of Patent: Mar. 11, 2003

(54) ANTITHEFT SYSTEM

(75) Inventor: Shinji Matsudaira, Daito (JP)

(73) Assignees: Sanyo Electric Co., Ltd., Osaka (JP); Sanyo Tuner Industries Co., Ltd., Osaka (JP)

( * ) Notice: Subject to any disclaimer, the term of this patent is extended or adjusted under 35 U.S.C. 154(b) by 169 days.

(21) Appl. No.: 09/822,416

(22) Filed: Apr. 2, 2001

(65) Prior Publication Data

US 2001/0038331 A1 Nov. 8, 2001

(30) Foreign Application Priority Data

Mar. 31, 2000 (JP) ..... 2000-098746

(51) Int. Cl.[7] ..... G08B 13/14
(52) U.S. Cl. ..... 340/571; 340/693.3
(58) Field of Search ..... 340/571, 693.3, 340/568.8, 568.1

(56) References Cited

U.S. PATENT DOCUMENTS 5,656,998 A * 8/1997 Fujiuchi et al. ..... 340/571

6,043,744 A * 3/2000 Masudaira ..... 340/571

* cited by examiner

*Primary Examiner*—Thomas Mullen
(74) *Attorney, Agent, or Firm*—Rader, Fishman & Grauer PLLC

(57) ABSTRACT

The invention provides an antitheft system comprising an alarm unit 1 attachable to a commodity, and an antitheft gate 2 installed in the vicinity of an exit of a store and having incorporated therein a transmitting circuit for producing an alarm activating signal for the alarm unit 1. The alarm unit 1 comprising a buzzer 1, receiving antenna 15 and control circuit 18. The control circuit 18 comprises an interrupt detecting circuit 18*b* alternatively settable in an interrupt permitting mode wherein the signal received by the antenna 15 is permitted to pass through the circuit 18*b* or an interrupt prohibiting mode wherein the received signal is prevented from passing therethrough, and a CPU 18*a* for judging whether the received signal input from the interrupt detecting circuit 18*b* is the alarm activating signal. The CPU 18*a* activates the buzzer 11 when the received signal is the alarm activating signal, while setting the detecting circuit 18*b* in the interrupt prohibiting mode for a predetermined period of time when the received signal is not the alarm activating signal. This suppresses shortening of the life of battery due to useless power consumption of the alarm unit 1.

4 Claims, 10 Drawing Sheets

START
PERMIT INTERRUPT
S1
MAIN CLOCK OFF
S2
SWITCH PIECE OFF ?
S3
Yes
No
PERMIT INTERRUPT
S4
MAIN CLOCK ON
S5
A
INTERRUPT SIGNAL RECEIVED ?
S6
No
Yes
MAIN CLOCK ON
S7
TIME ELAPSED ?
S12
No
Yes
PERMIT INTERRUPT
S13
ALARM ACTIVATING SIGNAL ?
S8
Yes
A
No
PROHIBIT INTERRUPT
S9
MAIN CLOCK OFF
S10
START TIME MEASURING OPERATION
S11

ANTITHEFT SYSTEM

FIELD OF THE INVENTION

The present invention relates to antitheft systems for protecting merchandise on display in stores from unlawful acts such as shoplifting, and more particularly to an antitheft system which comprises a signal transmitter incorporated, for example, in an antitheft gate for producing an alarm activating signal, and a self-sounding alarm unit attached to a commodity or like article to be protected from theft and adapted to generate sound in response to the alarm activating signal received from the signal transmitter.

BACKGROUND OF THE INVENTION

FIG. 9 shows an antitheft system conventionally used in stores wherein commodities such as compact disk cassettes and magnetic tape cassettes are on display for sale, to protect these articles from shoplifting or like illegal acts.

The antitheft system comprises an antitheft gate 2 installed in the vicinity of an exit 5 of the store, and an alarm unit 4 attached to a commodity 6. The antitheft gate 2 has a circuit board 21 and a transmitting antenna (not shown) which are incorporated therein. The circuit board 21 is provided with a transmitting circuit for producing an alarm activating signal for the alarm unit 4.

With reference to FIG. 10, the alarm unit 4 comprises a buzzer 41, circuit board 42, battery (not shown), etc. which are housed in a casing 40. The casing 40 has a surface provided with sound emitting holes 43 and an alarm actuating switch piece 44 projecting therefrom. The buzzer 41 has its operation controlled by the circuit board 42 and is adapted to produce an alarm when the unit 4 is removed from the commodity 6 or when the unit 4 passes by the antitheft gate 2.

The commodity 6 is placed on display in the store, with the alarm unit 4 attached thereto. When selling the commodity to the customer, the clerk holds the buzzer 41 out of operation by sending a specified signal to the circuit board 42 of the alarm unit 4 from a nullifying device (not shown), then removes the unit 4 from the commodity 6 and hands the commodity 6 to the customer in exchange for money.

If the customer wrongfully removes the alarm unit 4 from the commodity 6, the switch piece 44 is turned off to actuate the buzzer 41. Further if the customer acts to unlawfully bring the commodity 6 out of the store along with the alarm unit 4, the circuit board 42 of the alarm unit 4 receives an alarm activating signal from the transmitting antenna of the antitheft gate 2 to turn on the buzzer 41.

FIG. 11 shows the electrical construction of the alarm unit 4.

The alarm unit 4 has a receiving antenna 46 comprising a coil and a capacitor and connected to a control circuit 48 via a signal amplification circuit 47. The aforementioned battery (primary battery) 45 is connected to the signal amplification circuit 47 and the control circuit 48. These circuits 47, 48 are energized by the primary battery 45 to operate as specified. The control circuit 48 is provided with the alarm actuating switch piece 44 and has the buzzer 41 connected thereto.

The receiving antenna 46 receives a signal, which is fed to the amplification circuit 47 for amplification and then fed to the control circuit 48. The control circuit 48 judges whether the signal fed from the amplification circuit 47 is an alarm activating signal from the antitheft gate 2, and gives a drive command to the buzzer 41 if the signal is the activating signal. The control circuit 48 further detects opening of the alarm actuating switch piece 44 when it is turned off, giving a drive command to the buzzer 41. Thus, the buzzer 41 goes on in response to the drive command given by the control circuit 48.

With the alarm unit 4 of the type described, the primary battery 45 incorporated therein is replaced when the life of the battery 45 terminated. The alarm unit 4 is usually attached to each commodity in the store, and many alarm units 4 are in use. It is therefore likely that the primary batteries of many alarm units 4 need to be replaced at the same time. The replacement of batteries of many alarm units 4 is very cumbersome and costly. It is accordingly required to suppress the power consumption of the alarm unit 4 to the greatest possible extent.

However, the conventional alarm unit 4 is so adapted that whenever electromagnetic waves from one source or another are received by the receiving antenna 46, the control circuit 48 judges whether the waves are an alarm activating signal from the antitheft gate 2. When a commodity having the alarm unit 4 attached thereto is on display as positioned, for example, in the vicinity of an inverter fluorescent lamp, the electromagnetic waves emitted by the lamp at all times are received by the antenna 46, permitting the control circuit 48 to continuously perform the signal judging operation, hence the problem of wasting electric power to shorten the battery life. The life of the primary battery 45 is about 3 to about 5 years when the alarm unit 4 is not exposed to the electromagnetic waves from the inverter fluorescent lamp, whereas the life becomes shortened to 1 to 2 weeks if the unit 4 is held exposed to noise signals.

SUMMARY OF THE INVENTION

An object of the present invention is to provide an antitheft system comprising an alarm unit which is adapted to suppress the shortening of battery life due to useless power consumption.

The present invention provides an antitheft system comprising an alarm unit attachable to an article to be protected from theft, and a signal transmitter for transmitting an alarm activating signal to the alarm unit, the alarm unit comprising:

receiving means for receiving signals from outside, alarm means for producing an alarm in response to an alarming command, nullifying means operable in response to a nullifying command to nullify the signal received by the receiving means for a predetermined period of time subsequent to the reception of the nullifying command, and control means operable upon reception of the received signal from the receiving means to judge whether the received signal is the alarm activating signal and give the alarming command to the alarm means when the signal is the alarm activating signal or give the nullifying command to the nullifying means when the signal is not the alarm activating signal.

In the case where the antitheft system of the invention is installed in a store, the commodities to be protected against theft are placed on a display counter, with the alarm unit attached to each commodity, while the signal transmitter is disposed in an warning area in the vicinity of the exit of the store.

The receiving means of the alarm unit in this state is likely to receive external noise signals, such as electromagnetic waves being emitted by electric lamps. At this time, the control means judges whether the received signal is an alarm activating signal. Upon finding that the received signal is not the alarm activating signal, the control means gives a nullifying command to the nullifying means, which in turn nullifies the received signal for a predetermined period of time subsequent to the reception of the signal. This period of time is such that will cause no trouble to the operation of the alarm unit to be described below, e.g., 200 msec. Consequently, the control means is forced to cease the signal judging operation for the predetermined period of time despite the reception of signals by the receiving means. Accordingly, if the display counter is positioned in the vicinity of an inverter fluorescent lamp, the receiving means will receive the electromagnetic waves being emitted by the fluorescent lamp at all time, while the control means performs the signal judging operation intermittently.

If the customer passes through the warning area in the vicinity of the store exit in an attempt to wrongfully bring a commodity out of the store, the receiving means of the alarm unit attached to the commodity will receive an alarm activating signal from the signal transmitter, and the control means judges whether the received signal is the alarm activating signal during a period other than the predetermined period mentioned. Upon finding that the received signal is the activating signal, the control means gives an alarming command to the alarm means, which in turn produces an alarm, thus notifying the clerk of the unlawful act.

In the case where the display counter is disposed in the vicinity of an inverter fluorescent lamp, the control means intermittently performs the signal judging operation as described above, so that the alarm unit of the present invention is smaller in useless power consumption by the control means than the conventional alarm unit wherein the signal judging operation is performed continuously in such a case. This suppresses the shortening of the battery life.

Stated more specifically, the nullifying means of the alarm unit comprises a gate circuit interposed between the receiving means and the control means and operable in response to the nullifying command to prevent the signal received by the receiving means from passing through the gate circuit for a predetermined period of time subsequent to the reception of the nullifying command.

When the signal received by the receiving means is not the alarm activating signal and even if a signal is received by the receiving means during the subsequent predetermined period of time, the received signal is prevented by the nullifying means from passing through this means and is not input to the control means. The control means is therefore held out of the signal judging operation.

Further stated more specifically, the alarm unit comprises signal processing means capable of processing as specified the signal received by the receiving means and feeding the processed signal to the control means while being supplied with electric power, and power source means for supplying electric power to the signal processing means, and the nullifying means comprises a deenergizing circuit operable in response to the nullifying command to cease the supply of electric power from the power source means to the signal processing means for a predetermined period of time subsequent to the reception of the nullifying command.

When the signal received by the receiving means is not the alarm activating signal in the case of the alarm unit thus constructed, the supply of electric power from the power source means to the signal processing means is ceased for the subsequent predetermined period of time, rendering the signal processing means unable to perform the specified signal processing operation. Even if a signal is received by the receiving means during the predetermined period of time, it is therefore unlikely that the received signal will be input from the signal processing means to the control means, and the control means is held out of the signal judging operation.

When the display counter is positioned in the vicinity of an inverter fluorescent lamp as described above, electric power is intermittently supplied from the power source means to the signal processing means in the case of the construction described above, hence reduced power consumption by the signal processing means. This further diminishes useless power consumption.

Stated further specifically, the control means of the alarm unit judges whether the received signal is the alarm activating signal in response to a clock signal supplied from outside, and the alarm unit further comprises clock supply means for supplying the clock signal to the control means, and a clock halting control means for ceasing the clock signal supplying operation of the clock supply means for the predetermined period of time when the received signal is not found to be the alarm activating signal.

When the signal received by the receiving means is not the alarm activating signal in the case of the alarm unit thus constructed, the operation of the clock supply means for supplying the clock signal to the control means is ceased for the subsequent predetermined period of time. Since the control means is forced to cease the signal judging operation for the predetermined period of time as already described, the cessation of supply of the clock signal to the control means causes no trouble to the operation of the control means.

When the display counter is positioned in the vicinity of an inverter fluorescent lamp as described above, the clock supply means intermittently performs the clock signal supplying operation. This feature of the construction described reduces the power consumption by the clock supply means, consequently further diminishing useless power consumption.

As described above, the antitheft system according to the present invention diminishes the useless power consumption by the alarm unit to thereby suppress the shortening of battery life.

DETAILED DESCRIPTION OF EMBODIMENTS

A detailed description will be given of two embodiments of the present invention.

First Embodiment

Figure 9:
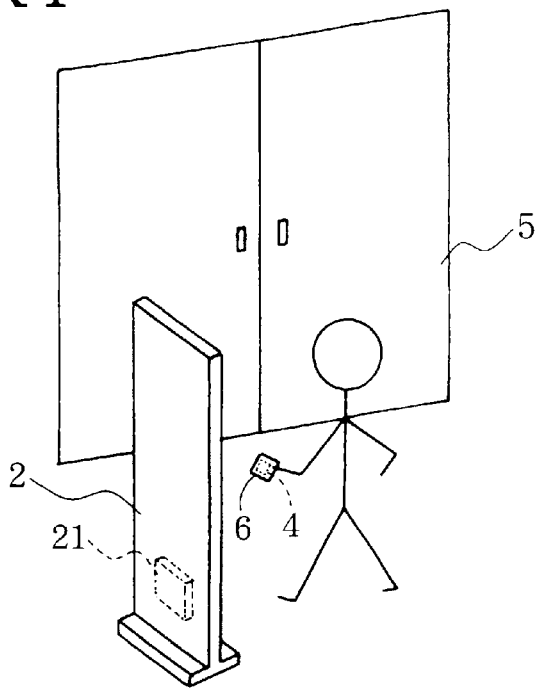
FIG. 9 PRIOR ART
FIG. 9 is a perspective view showing an antitheft gate.

Like the conventional antitheft system shown in FIG. 9, the antitheft system of this embodiment comprises an antitheft gate 2 and an alarm unit 1. The antitheft gate 2 is installed in the vicinity of an exit 5 of a store, while the alarm unit is attached to a commodity on display in the store.

Figure 2:
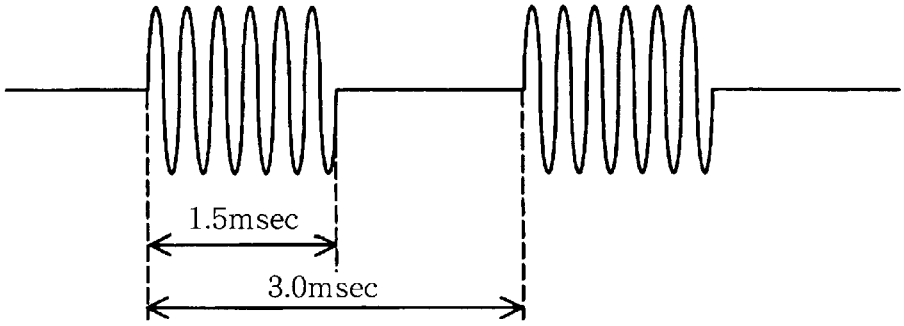
FIG. 2 is a waveform diagram showing an alarm activating signal.

The antitheft gate 2 has exactly the same construction as in the prior art. A transmitting antenna (not shown) incorporated in the gate transmits an alarm activating signal to the outside. The alarm activating signal comprises burst waves of predetermined pattern and is 3.0 msec in period and 1.5 msec in on-period as seen in FIG. 2.

Figure 1:
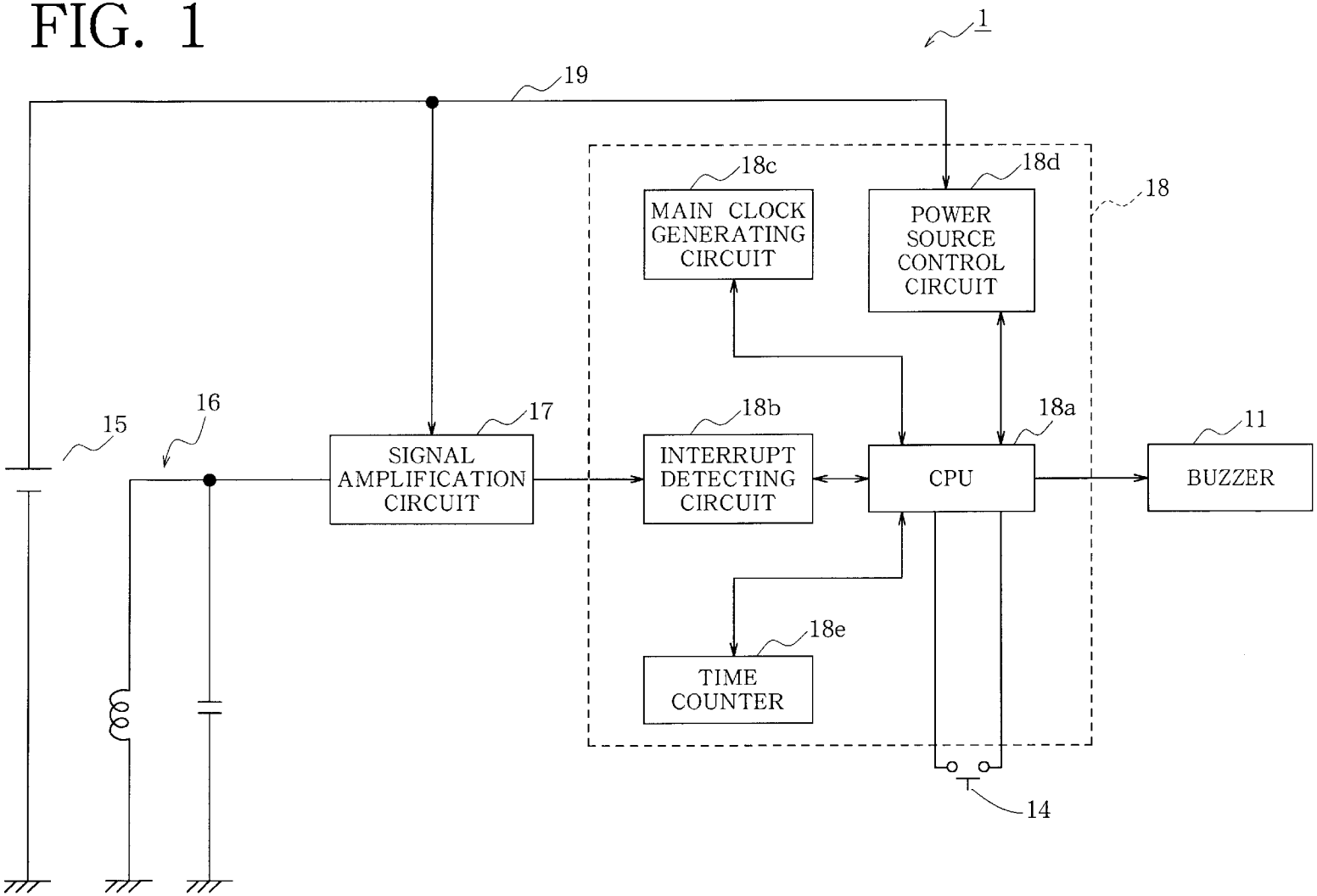
FIG. 1 is a block diagram showing the electrical construction of alarm unit of a first embodiment.
Figure 10:
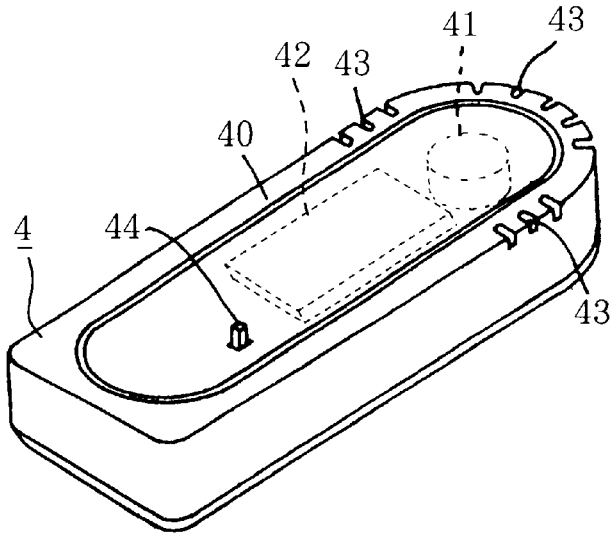
FIG. 10 PRIOR ART
FIG. 10 is a perspective view showing the appearance of a conventional alarm unit.
Figure 11:
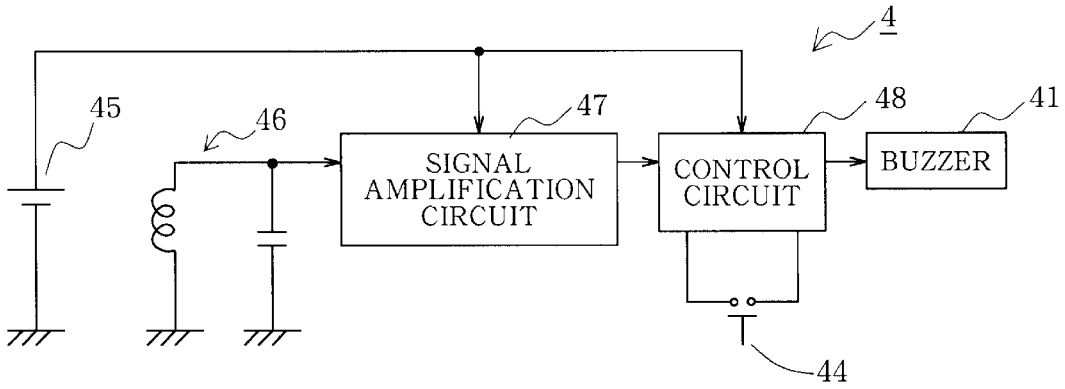
FIG. 11 PRIOR ART
FIG. 11 is a block diagram showing the electrical construction of the alarm unit.

FIG. 1 shows the electrical construction of the alarm unit 1 of the present embodiment. The alarm unit 1 has the same appearance as the conventional alarm unit 4 shown in FIG. 10, so that the appearance will not be described.

As shown in FIG. 1, the alarm unit 1 of the present embodiment has a receiving antenna 16 comprising a coil and a capacitor. The receiving antenna 16 is connected to a control circuit 18 via a signal amplification circuit 17. A primary battery 15 is connected to the amplification circuit 17 and the control circuit 18 by a power supply line 19. Further connected to the control circuit 18 are a buzzer 11 and an alarm actuating switch piece 14.

The control circuit 18 of the present embodiment comprises a CPU 18*a*, interrupt detecting circuit 18*b* connected to the CPU 18*a*, main clock generating circuit 18*c*, power source control circuit 18*d* and time counter 18*e*, and is provided, for example, by a microcomputer.

The power supply line 19 extending from the primary battery 15 is connected to the power source control circuit 18*d*, which supplies electric power from the battery 15 to the CPU 18*a*, interrupt detecting circuit 18*b*, main clock generating circuit 18*c* and time counter 18*e* by way of power supply lines which are not shown.

The main clock generating circuit 18*c* is brought into or out of operation under the control of the CPU 18*a*. In response to an operation-on command given by the CPU 18*a*, the circuit 18*c* starts the operation of preparing a main clock signal of predetermined period and supplying the main clock signal to the CPU 18*a*, interrupt detecting circuit 18*b*, power source control circuit 18*d* and time counter 18*e*. As a result, the control circuit 18 is set in a usual mode wherein the CPU 18*a*, interrupt detecting circuit 18*b*, power source control circuit 18*d* and time counter 18*e* operate in response to the main clock signal. In response to an operation-off command, on the other hand, the main clock generating circuit 18*c* ceases the operation of preparing the clock signal and supplying the signal. At this time, a subclock signal is supplied from an unillustrated subclock generating circuit to the CPU 18*a* and time counter 18*e*, and the control circuit 18 is set in a power saving mode in which the CPU 18*a* and the time counter 18*e* only operate in response to the subclock signal.

The CPU 18*a* has connected thereto the buzzer 11 and the alarm actuating switch piece 14, and recognizes the closed state of the switch piece 14 as "on state," and the open state thereof as "off state." The CPU 18*a* recognizes the switch piece 14 as "off" when it is opened, giving an alarming command to the buzzer 11. In response to the alarming command, the buzzer 11 starts to buzz.

The interrupt detecting circuit 18*b* is alternatively settable in an interrupt permitting mode wherein the signal supplied from the signal amplification circuit 17 is permitted to pass through the circuit 18*b*, or in an interrupt prohibiting mode wherein the passage of the signal is prevented. The mode is changed over under the control of the CPU 18*a*.

The signal received by the receiving antenna 16 is fed to the signal amplification circuit 18*b* for amplification and thereafter fed to the interrupt detecting circuit 18*b*. In the case where the circuit 18*b* is set in the interrupt permitting mode, the signal fed to the circuit 18*b* is permitted to pass through the circuit 18*b* and input to the CPU 18*a* as an interrupt signal, whereas when the circuit 18*b* is set in the interrupt prohibiting mode, the signal is prevented from passing through the circuit 18*b* and is not input to the CPU 18*a*.

While the buzzer 11 is mute, the CPU 18*a* judges whether the interrupt signal input from the interrupt detecting circuit 18*b* is the alarm activating signal from the antitheft gate 2. When the signal is the activating signal, CPU gives an alarming command to the buzzer 11, which in turn starts to buzz in response to the command.

if the interrupt signal is not the alarm activating signal, the CPU 18*a* gives an interrupt prohibiting command to the interrupt detecting circuit 18*b*. Subsequently, the CPU causes the time counter 18*e* to start a time measuring operation, and starts to judge whether a predetermined period of time, e.g., 200 msec, has elapsed with reference to the output value of the counter 18*e*. Upon detecting the lapse of the predetermined period of time, the CPU gives an interrupt permitting command to the interrupt detecting circuit 18*b*. In response to the interrupt prohibiting command, the circuit 18*b* is set in the interrupt prohibiting mode. Subsequently, the circuit 18*b* is set in the interrupt permitting mode in response to the interrupt permitting command upon lapse of the predetermined period of time.

In the case where the signal received by the antenna 16 is not the alarm activating signal, the interrupt detecting circuit 18*b* is thus set in the interrupt prohibiting mode for the predetermined period of time. Accordingly, even if some signal is received by the antenna 16 during this period, the received signal is unlikely to be input from the circuit 18*b* to the CPU 18*a* as an interrupt signal as stated above, and the CPU 18*a* is held out of the signal judging operation of determining whether the interrupt signal is the alarm activating signal. In this way, the CPU 18*a* is forced to cease the signal judging operation for the predetermined period of time despite the reception of the signal by the antenna 16.

While the buzzer 11 is on, the CPU 18*a* judges whether the interrupt signal input from the interrupt detecting circuit 18*b* is a nullifying signal from a nullifying device (not shown). If the signal is the nullifying signal, the CPU gives an alarm halting command to the buzzer 11. In response to the command, the buzzer 11 ceases buzzing.

Figure 3:
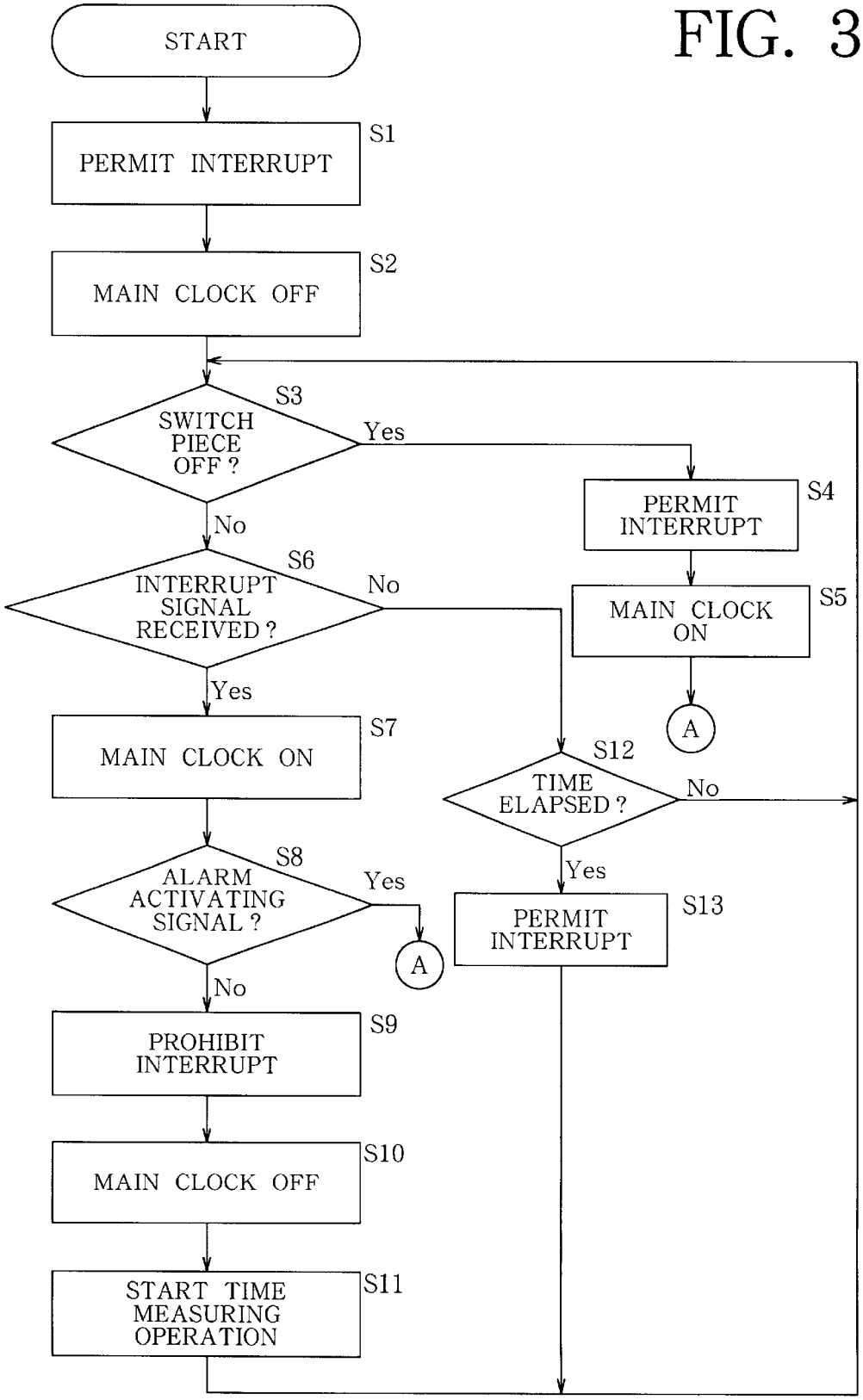
FIG. 3 is a flow chart showing the alarm control procedure to be performed by a CPU of the first embodiment.
Figure 4:
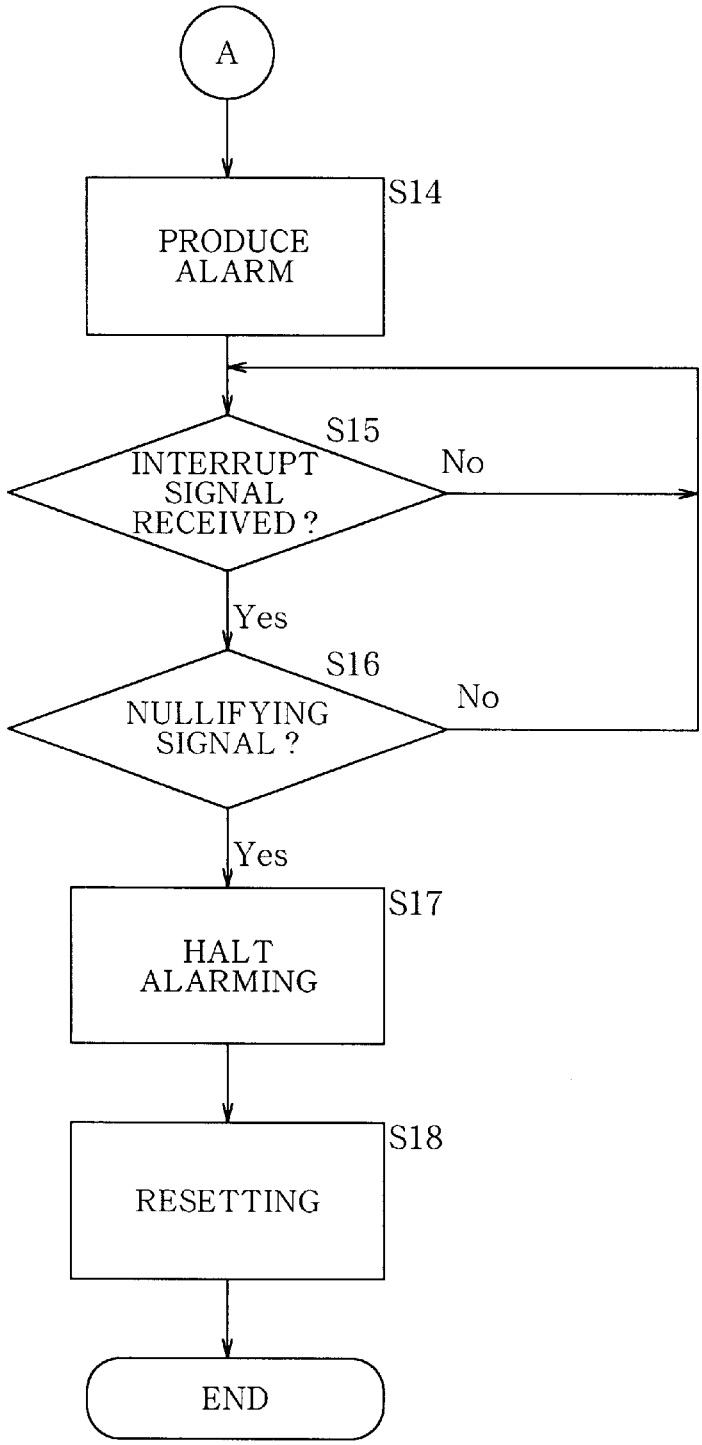
FIG. 4 is a flow chart of part of FIG. 3.

FIGS. 3 and 4 show the alarm control procedure to be performed by the CPU 18*a* of the control circuit 18. Incidentally, the alarm unit 1 can be changed over between a set state and a reset state. In the set state, the unit produces an alarm, with the switch piece 14 turned off or in response to the alarm activating signal. In the reset state, the unit is forced to cease alarming, with the switch piece 14 turned off and in response to the alarm activating signal.

When the switch piece 14 is held on for at least the predetermined period of time to bring the alarm unit 1 in the set state, the CPU gives an interrupt permitting command to the interrupt detecting circuit 18*b* first in step S1, and thereafter outputs an operation-off command to the main clock generating circuit 18*c* in step S2. As a result, the interrupt detecting circuit 18*b* is set in the interrupt permitting mode, and the main clock generating circuit 18*c* ceases the clock signal supplying operation to set the control circuit 18 in the power saving mode.

The CPU then inquires whether the alarm actuating switch piece 14 is off in step S3. If the answer is affirmative, step S4 follows for the CPU to give an interrupt permitting command to the interrupt detecting circuit 18*b*. An opening-on command is thereafter given to the main clock generating circuit 18*c* in step S5, followed by step S14 in FIG. 4. Consequently, in the case where the interrupt detecting circuit 18*b* is set in the interrupt prohibiting mode, the circuit 18*b* is changed over to the interrupt permitting mode, and the control circuit 18 is set in the usual mode, with the main clock generating circuit 18*c* starting to supply a clock signal.

On the other hand, if the inquiry of step S3 is answered in the negative, step S6 follows in which an inquiry is made as to whether an interrupt signal is received from the detecting circuit 18*b*.

In the case where some signal is received by the antenna 16, with the interrupt detecting circuit 18*b* set in the interrupt permitting mode, the received signal is input as an interrupt signal, so that the inquiry of strep S6 is answered in the affirmative. An operation-on command is given to the main clock generating circuit 18*c* in the next step S7. Consequently, the control circuit 18 is set in the usual mode, with the main clock generating circuit 18*c* initiated into clock signal supplying operation.

Subsequently in step S8, an inquiry is made as to whether the interrupt signal is the alarm activating signal. If the answer is affirmative, the sequence proceeds to step S14 in FIG. 4.

If the inquiry of step S8 is answered in the negative, on the other hand, step S9 follows in which an interrupt prohibiting command is given to the interrupt detecting circuit 18*b*. An operation-off command is thereafter given to the main clock generating circuit 18*c* in step S10. Consequently, the interrupt detecting circuit 18*b* is changed over to the interrupt prohibiting mode, the main clock generating circuit 18*c* ceases the clock signal supplying operation, and the control circuit 18 is set in the power saving mode.

Subsequently in step S11, the time counter 18*e* is initiated into a time measuring operation, followed by step S3 again. As previously stated, the time counter 18*e* performs its operation in response to a subclock signal from the subclock generating circuit.

Even if some signal is received by the antenna 16 in the case where the interrupt detecting circuit 18*b* is set in the interrupt prohibiting mode, the received signal is not input to the circuit 18*b* as an interrupt signal, and a negative answer is always given to the inquiry of step S6. When the inquiry of step S6 is thus answered in the negative, the sequence proceeds to step S12, in which inquiry is made as to whether a predetermined period of time has elapsed after the circuit 18*b* is set in the interrupt prohibiting mode, with reference to the output value of the time counter 18*e*. If the answer is negative, step S3 follows again.

Upon lapse of the predetermined period of time after the interrupt detecting circuit 18*b* is set in the interrupt prohibiting mode, the inquiry of step S12 is answered in the affirmative. Step S13 then follows to give an interrupt permitting command to the circuit 18*b*, followed by step S3 again. Consequently, the detecting circuit 18*b* is changed over to the interrupt permitting mode.

When the switch piece 14 is turned off, and if the inquiry of step S3 is answered in the affirmative, followed by steps S4 and S5 as stated above, or when the interrupt signal is the alarm activating signal and if the inquiry of step S8 is answered in the affirmative, an alarming command is output to the buzzer 11 in step S14 of FIG. 4. As a result, the buzzer 11 starts to produce an alarm.

Subsequently, an inquiry is made in step S15 as to whether the interrupt signal from the circuit 18*b* is received. At this time, the circuit 18*b* is set in the interrupt permitting mode as previously stated. Accordingly, when some signal is received by the antenna 16, the received signal is input from the circuit 18*b* as an interrupt signal, and the inquiry of step S15 is answered in the affirmative, whereas the answer is negative if no signal is received by the antenna 16.

When the answer to the inquiry of step S15 is negative, the same inquiry is repeated to continue the alarming operation of buzzer 11.

On the other hand, if the answer to step S15 is affirmative, step S16 follows in which an inquiry is made as to whether the interrupt signal is a nullifying signal. If the inquiry is answered in the negative, step S15 follows again to continue the alarming operation of the buzzer 11.

When the interrupt signal is the nullifying signal and if step S16 is answered in the affirmative, an alarm halting command is given to the buzzer 11 in step S17 to bring the buzzer 11 out of the alarming operation.

Finally, the alarm unit 1 is reset in step S18 as specified to complete the foregoing procedure. Thus, the unit 1 is set in the reset state.

With the antitheft system of the present embodiment, the alarm unit 1 is attached to a commodity, which is then placed on a display counter, whereby the alarm actuating switch piece 14 of the alarm unit 1 is turned on by being pressed by the outer surface of the commodity. Upon lapse of a predetermined period of time thereafter, the unit 1 is set, the interrupt detecting circuit 18*b* of the unit 1 is set in the interrupt permitting mode and the control circuit 18 is set in the power saving mode in steps S1, S2 of FIG. 3.

For example, in the case where the display counter is positioned in the vicinity of an inverter fluorescent lamp, electromagnetic waves emitted by the lamp at all times are received by the receiving antenna 16 of the alarm unit 1. With the circuit 18*b* set in the interrupt permitting mode as described above, therefore, the electromagnetic waves from the inverter fluorescent lamp are input to the CPU 18*a* as an interrupt signal, the inquiry of step S6 is answered in the affirmative, the control circuit 18 is changed over to the usual mode in step S7. Step S8 is thereafter answered in the negative, the circuit 18*b* is changed over to the interrupt prohibiting mode and the control circuit 18 to the power saving mode respectively in steps S9 and S10. In this state, no electromagnetic waves are input to the CPU 18*a* as an interrupt signal to give a negative answer to step S6. Until a predetermined period of time elapses after the circuit 18*b* is set in the interrupt prohibiting mode, a negative answer is given to the inquiry of sep S12 to hold the circuit 18*b* in the interrupt prohibiting mode.

Upon lapse of the predetermined period of time, the circuit 18*b* is changed over to the interrupt permitting mode in step S13. In this state, the electromagnetic waves from the inverter fluorescent lamp are input to the CPU 18*a* as an interrupt signal, the inquiry of step S6 is answered in the affirmative, the control circuit 18 is changed over in step S7, a negative answer is given to step S8, and the interrupt detecting circuit 18*b* is changed over to the interrupt prohibiting mode again.

The circuit 18*b* is then similarly changed over between the interrupt permitting mode and the prohibiting mode. With the circuit 18*b* set in the interrupt permitting mode, the control circuit 18 is set in the usual mode, while the circuit 18 is set in the power saving mode with the circuit 18*b* set in the interrupt prohibiting mode.

If the customer unlawfully removes the alarm unit 1 from the commodity, step S3 is answered in the affirmative, the circuit 18*b* is changed over to the interrupt permitting mode and the CPU 18*a* to the usual mode in steps S4 and S5, respectively, and an alarm is given in step S14 of FIG. 4.

Further if the customer moves past the vicinity of the store exit 5 in an attempt to bring the commodity having the alarm unit 1 attached thereto out of the store, an alarm activating signal is fed from the antitheft gate 2 to the CPU 18*a* as an interrupt signal, FIG. 3, step S6 is answered in the affirmative and the control circuit 18 is changed over to the usual mode in step S7. Step S8 is thereafter given an affirmative answer, and an alarm is produced in FIG. 4, step S14.

If the clerk manipulates the nullifying device to send a nullifying signal to the alarm unit 1 thus alarming, the nullifying signal is input to the CPU 18*a* as an interrupt signal, steps S15 and S16 are answered in the affirmative, the alarm is halted in step S17, and the alarm unit 1 is reset in step S18.

In the case wherein the commodity having the alarm unit 1 attached thereto is placed on the display counter positioned in the vicinity of the inverter fluorescent lamp, the interrupt detecting circuit 18*b* is changed over between the interrupt permitting mode and the interrupt prohibiting mode as stated above. Only when the interrupt detecting circuit 18*b* of the control circuit 18 is set in the interrupt permitting mode, the CPU 18*a* intermittently performs the signal judging procedure of FIG. 3, step S8. Accordingly, the signal judging procedure is executed intermittently by the CPU 18*a*, so that the alarm unit 1 is smaller in the power consumption by the CPU 18*a* than the conventional alarm unit 4 wherein the CPU continuously performs the signal judging operation. Further because the clock signal supply operation of the main clock generating circuit 18*c* is ceased while the circuit 18*b* is set in the interrupt prohibiting mode, the power consumption by the circuit 18*c* is smaller. In this way, the alarm unit 1 is diminished in useless power consumption to suppress the shortening of the life of battery as compared with the conventional alarm unit 4.

Table 1 below shows the current values to be consumed by the signal amplification circuit 17 and the control circuit 18 of the alarm unit 1. State 1 in Table 1 is such a state in which the signal judging operation is not performed, with no signal received by the antenna 1 and with the control circuit 18 set in power saving mode, and state 2 is such a state in which the signal judging operation is being performed, with some signal received by the antenna 16 and with the control circuit 18 set in the usual mode.

TABLE 1

| | Amp. circuit | Control circuit | Total |
|---|---|---|---|
| State 1 | 3–5 μA | Up to 1 μA | About 5 μA |
| State 2 | About 10 μA | About 500 μA | About 500 μA |

When external noise signals, such as the above-mentioned electromagnetic waves from the inverter fluorescent lamp, are received by the receiving antenna at all times, the conventional alarm unit 4 consumes about 500 μA of current.

With the alarm unit 1 of the present embodiment, the signal judging operation is performed for about 3 msec, during which about 500 μA of current flows. Further interrupt detecting circuit 18*b* is set in the interrupt prohibiting mode for about 200 msec, and about 10 μA of current flows at this time. Accordingly, the average current value to be consumed by the alarm unit 1 is calculated from the Mathematic Expression 1 given below.

$$\{3\ msec/(200\ msec+3\ msec)\}\cdot 500\ \mu A+\{200\ msec/(200\ msec+3\ msec)\}\cdot 10\ \mu A=17.2\ \mu A$$

Thus, the alarm unit 1 of the present embodiment consumes 17.2 μA of current on the average. This value is much smaller than the corresponding value of 500 μA consumed by the conventional alarm unit 4.

Second Embodiment

FIG. 3 shows the electrical construction of an alarm unit 3 of this embodiment. The appearance of the unit 3 is the same as that of the conventional alarm unit 4 shown in FIG. 10 and will not be described therefore.

Figure 5:
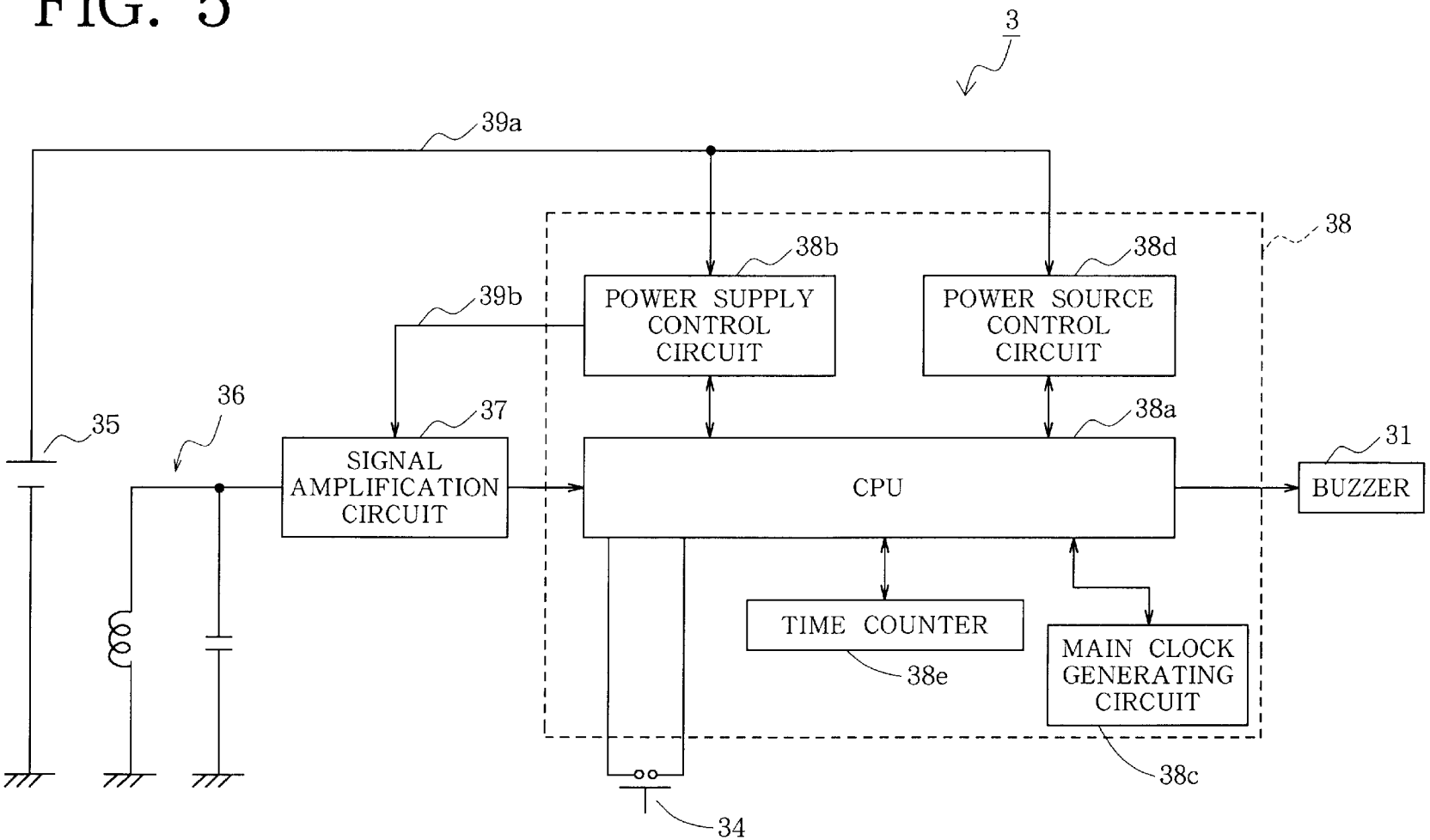
FIG. 5 is a block diagram showing the electrical construction of alarm unit of a second embodiment.

With reference to FIG. 5, the alarm unit 3 of this embodiment, like the alarm unit of the first embodiment, comprises a receiving antenna 36, signal amplification circuit 37 and control circuit 38, and a primary battery 35 is connected to the control circuit 38 by a main power supply line 39*a*. Further connected to the control circuit 38 are a buzzer 31 and an alarm actuating switch piece 34.

The control circuit 38 of the present embodiment comprises a CPU 38*a*, power supply control circuit 38*b* connected to the CPU 38*a*, main clock generating circuit 38*c*, power source control circuit 38*d* and time counter 38*e*, and is provided, for example, by a microcomputer.

The main power supply line 39*a* extending from the primary battery 35 is connected to the power source control circuit 38*d* and the power supply control circuit 38*b*. The circuit 38*d* supplies electric power from the battery 35 to the CPU 38*a*, main clock generating circuit 38*c* and time counter 38*e* by way of power supply lines which are not shown.

The powder supply control circuit 38*b* is brought into or out of operation under the control of the CPU 38*a*. In response to a power supply start command given by the CPU 38*a*, the circuit 38*b* starts the operation of supplying power from the battery 35 to the signal amplification circuit 37 via a secondary power supply line 39*b*. In response to a power supply halt command from the CPU 38*a*, the circuit 38*b* ceases the operation of supplying power to the amplification circuit 37. With power supplied to the circuit 37, this circuit 37 is in condition for a specified signal amplifying operation, while when unenergized, the circuit 37 is inoperative for signal amplification.

The CPU 38*a* has connected thereto the buzzer 31 and the alarm actuating switch piece 34, and recognizes the closed state of the switch piece 34 as "on state," and the open state thereof as "off state." The CPU 38*a* recognizes the switch piece 34 as "off" when it is opened, giving an alarming command to the buzzer 31. In response to the alarming command, the buzzer 31 starts to buzz.

The signal received by the antenna 36 is fed to the signal amplification circuit 37, which, when in condition for operation, amplifies the signal. The signal is then input as an interrupt signal to the CPU 38*a*, while when the circuit 37 is not operable, the signal supplied to the circuit 37 will not be amplified by the circuit 37 and will not be input the CPU 38*a*.

While the buzzer 31 is mute, the CPU 38*a* judges whether the interrupt signal input from the amplification circuit 37 is an alarm activating signal from an antitheft gate 2. When the signal is the activating signal, CPU gives an alarming command to the buzzer 31, which in turn starts to buzz in response to the command.

if the interrupt signal is not the alarm activating signal, the CPU 38*a* gives a power supply halt command to the power supply control circuit 38*b*. Subsequently, the CPU causes the time counter 38*e* to start a time measuring operation, and starts to judge whether a predetermined period of time, e.g., 200 msec, has elapsed with reference to the output value of the counter 38*e*. Upon detecting the lapse of the predetermined period of time, the CPU gives a power supply halt command to the power supply control circuit 38*b*. In response to the command, the circuit 38*b* ceases the supply of power to the amplification circuit 37. Subsequently, the circuit 18*b* starts to supply power to the amplification circuit 37 in response to a power supply start command upon lapse of the predetermined period of time. Consequently, the signal amplification circuit 37 becomes inoperable for the predetermined period of time and thereafter becomes operable.

In the case where the signal received by the antenna 36 is not the alarm activating signal, the amplification circuit 37 thus becomes inoperable for the predetermined period of time. Accordingly, even if some signal is received by the antenna 36 during this period, the received signal is unlikely to be input from the circuit 37 to the CPU 38*a* as an interrupt signal as described above, and the CPU 38*a* is held out of the signal judging operation of determining whether the interrupt signal is the alarm activating signal. In this way, the CPU 38*a* is forced to cease the signal judging operation for the predetermined period of time despite the reception of the signal by the antenna 36.

While the buzzer 31 is on, the CPU 38*a* judges whether the interrupt signal input from the amplification circuit 37 is a nullifying signal from a nullifying device (not shown). If the signal is the nullifying signal, the CPU gives an alarm halting command to the buzzer 31. In response to the command, the buzzer 31 ceases buzzing.

Figure 6:
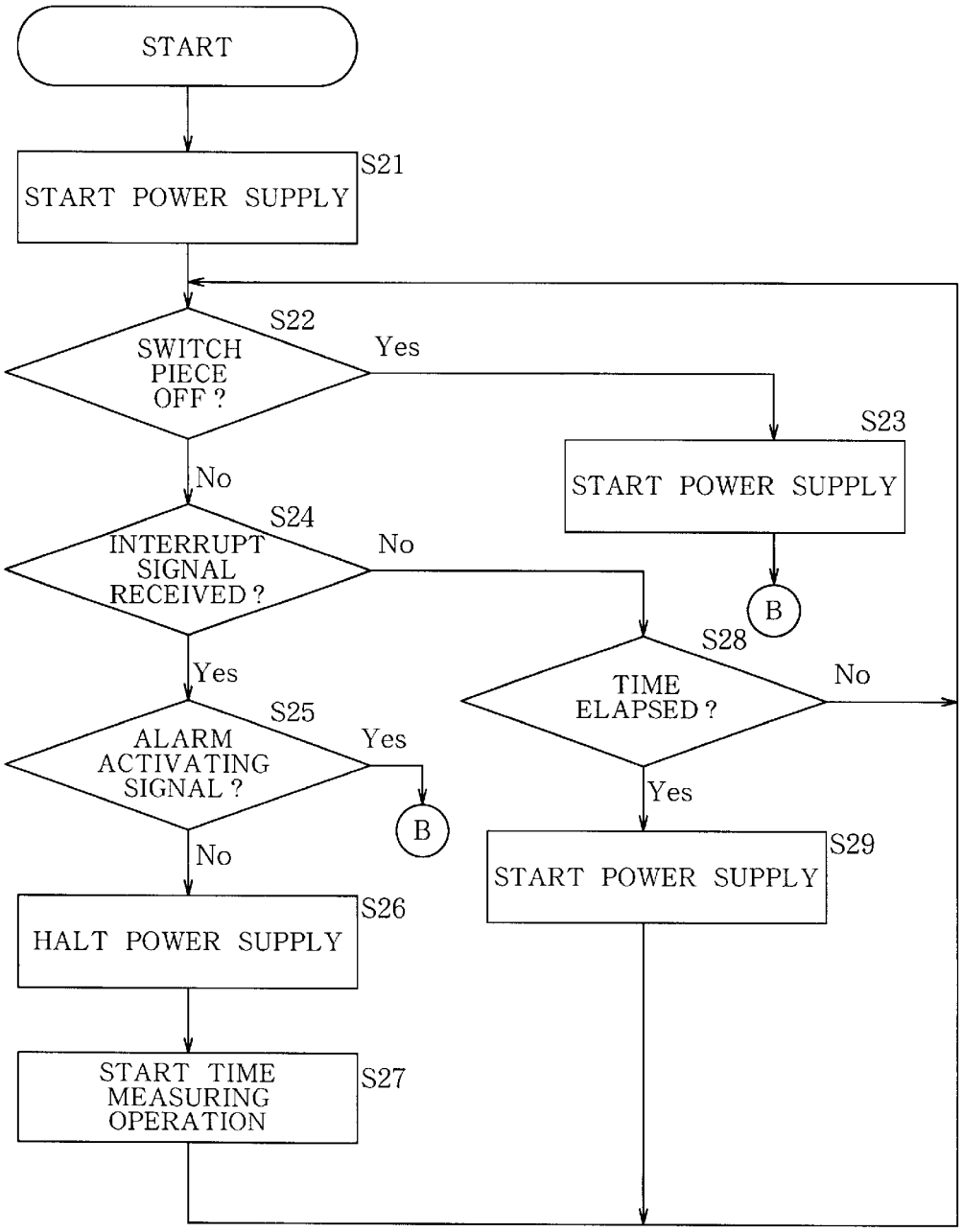
FIG. 6 is a flow chart showing the alarm control procedure to be performed by a CPU of the second embodiment.
Figure 7:
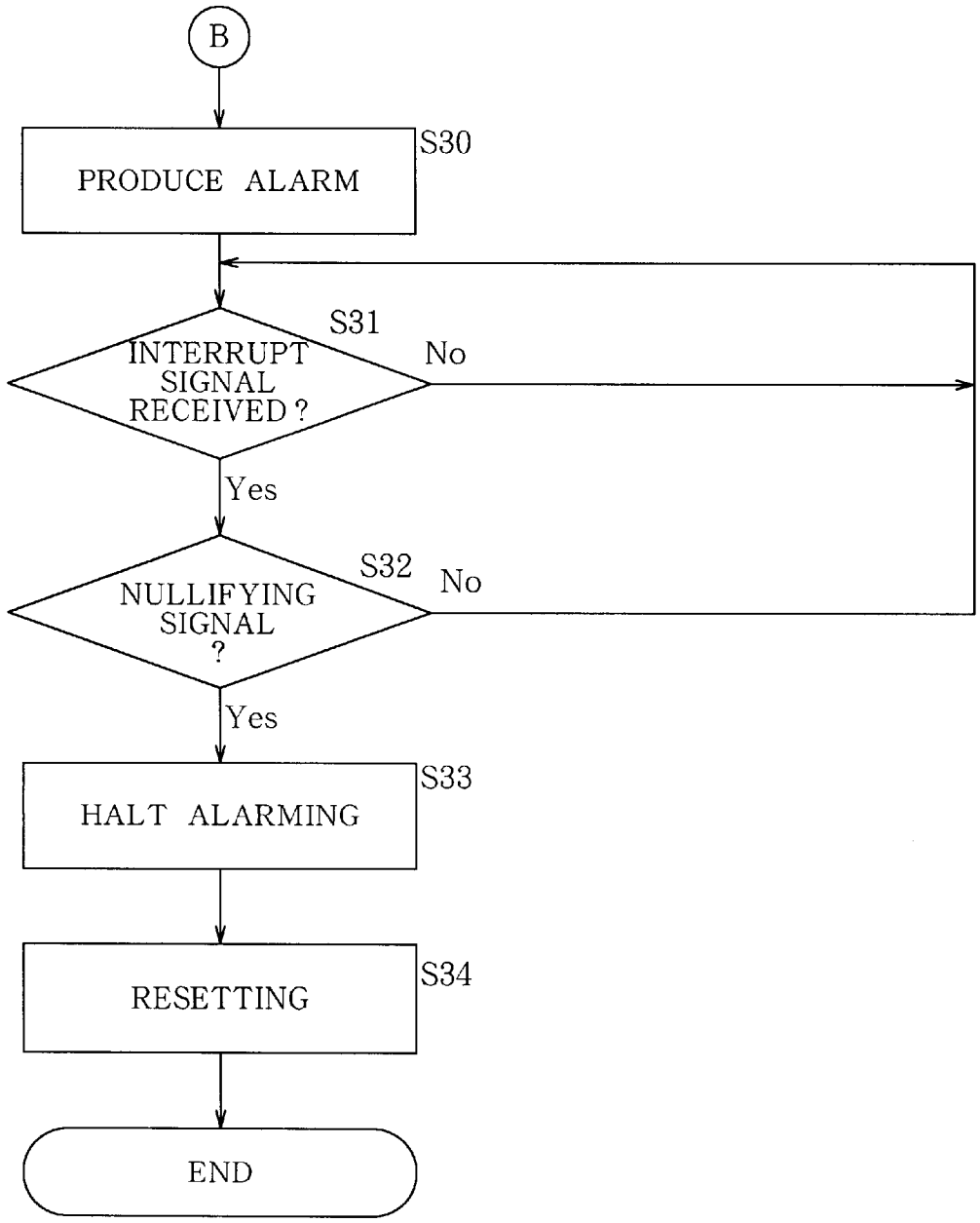
FIG. 7 is a diagram of part of FIG. 6.

FIGS. 6 and 7 show the alarm control procedure to be performed by the control circuit 38. Incidentally, the alarm unit 3 can be changed over between a set state and a reset state.

When the alarm unit 3 is set, with the alarm actuating switch piece 34 held on for at least a predetermined period of time, a power supply start command is given to the power supply control circuit 38*b* first in step S21. Consequently, the control circuit starts to supply power to the signal amplification circuit 37, bringing the circuit 37 into condition for operation.

Subsequently in step S22, an inquiry is made as to whether the switch piece 34 is off. If the answer is affirmative, step S23 follows to give a power supply start command to the power supply control circuit 38*b*, followed by step S30 of FIG. 7. When the amplification circuit 37 is inoperable, the supply of power to the circuit 37 is started to render the circuit 37 operable.

If the inquiry of step S22 is answered in the negative, on the other hand, step S24 follows to inquire whether an interrupt signal is received from the amplification circuit 37.

When some signal is received from the antenna 36, with the amplification circuit 37 in condition for operation, the received signal is amplified by the circuit 37 and then fed from the circuit 37 to the CPU, and the step S24 is answered in the affirmative.

Subsequently in step S25, an inquiry is made as to whether the interrupt signal is an alarm activating signal. If the answer is affirmative, step S30 of FIG. 7 follows.

If the answer to step S25 is negative, on the other hand, step S26 follows to give a power supply halt command to the power supply control circuit 38*b*. As a result, the supply of power to the amplification circuit 37 is discontinued to render the circuit 37 inoperative.

The time counter 38*e* then starts a time measuring operation in step S27, and the sequence returns to step S22.

Even if some signal is received by the antenna 36 in the case where the signal amplification circuit 37 is not in condition for operation, the received signal is not input from the circuit 37 to the CPU as an interrupt signal after amplification by the circuit 37, and a negative answer is always given to the inquiry of step S24. When the inquiry of step S24 is thus answered in the negative, the sequence proceeds to step S28, in which inquiry is made as to whether a predetermined period of time has elapsed after the circuit 37 becomes inoperable, with reference to the output value of the time counter 38*e*. If the answer is negative, step S22 follows again.

Upon lapse of the predetermined period of time after the circuit 37 becomes inoperative, the inquiry of step S28 is answered in the affirmative. Step S29 then follows to give a power supply start command to the power supply control circuit 38*b*, followed by step S22 again. Consequently, the supply of power to the circuit 37 is started, rendering the circuit 37 in condition for operation.

When the switch piece 34 is turned off, and if the inquiry of step S22 is answered in the affirmative, followed by step S23 as stated above, or when the interrupt signal is the alarm activating signal and if the inquiry of step S25 is answered in the affirmative, an alarming command is output to the buzzer 31 in step S30 of FIG. 7. As a result, the buzzer 31 starts to produce an alarm.

Subsequently, an inquiry is made in step S31 as to whether the interrupt signal from the amplification circuit 37 is received. At this time, the circuit 37 is in condition for operation as previously stated. Accordingly, when some signal is received by the antenna 36, the received signal is amplified by the circuit 37 and then fed to the CPU as an interrupt signal, and the inquiry of step S31 is answered in the affirmative, whereas the answer is negative if no signal is received by the antenna 36.

When the answer to the inquiry of step S31 is negative, the same inquiry of the step is repeated to continue the alarming operation of buzzer 31.

On the other hand, if the answer to step S31 is affirmative, step S32 follows in which an inquiry is made as to whether the interrupt signal is a nullifying signal. If the inquiry is answered in the negative, step S31 follows again to continue the alarming operation of the buzzer 31.

When the interrupt signal is the nullifying signal and if step S32 is answered in the affirmative, an alarm halting command is given to the buzzer 31 in step S33 to bring the buzzer 31 out of the alarming operation.

Finally, the alarm unit 3 is reset in step S34 as specified to complete the foregoing procedure. Thus, the unit 3 is set in the reset state.

With the antitheft system of the present embodiment, the alarm unit 3 is attached to a commodity, which is then placed on a display counter, whereby the alarm unit 3 is set. The amplification circuit 37 of the unit 3 is made operable in step S21 of FIG. 6.

For example, in the case where the display counter is positioned in the vicinity of an inverter fluorescent lamp, electromagnetic waves emitted by the lamp at all times are received by the receiving antenna 36 of the alarm unit 3. With signal amplification the circuit 37 in condition for operation as described above, therefore, the electromagnetic waves from the inverter fluorescent lamp are input to the CPU 38*a* as an interrupt signal, the inquiry of step S24 is answered in the affirmative, step Ps is answered in the negative, and the circuit 37 becomes inoperative in step S26. In this state, no electromagnetic waves are input to the CPU 38*a* as an interrupt signal to give a negative answer to step S24. Until a predetermined period of time elapses after the circuit 38 becomes inoperable, a negative answer is given to the inquiry of sep S28 to hold the circuit 37 inoperable.

Upon lapse of the predetermined period of time, the amplification circuit 37 is made operable in step S28. In this state, the electromagnetic waves from the inverter fluorescent lamp are input to the CPU 38*a* as an interrupt signal, the inquiry of step S24 is answered in the affirmative, step S25 is answered in the negative, and the amplification circuit 37 is rendered inoperable again.

The circuit 37 is then similarly made operative or inoperative alternatively.

In the case wherein the commodity having the alarm unit 3 of the present embodiment attached thereto is placed on the display counter positioned in the vicinity of the inverter fluorescent lamp, the amplification circuit 37 is changed over between the operative state and the inoperative state as stated above. Only when the circuit 37 is operative, the CPU 38*a* intermittently performs the signal judging procedure of FIG. 6, step S25. Accordingly, the signal judging procedure is executed intermittently by the CPU 38*a*, so that the alarm unit 3 is smaller in the power consumption by the CPU 38*a* than the conventional alarm unit 4 wherein the CPU continuously performs the signal judging operation. Further because power is supplied intermittently from the primary battery 35 to the amplification circuit 37, the power consumption by the circuit 37 is smaller. In this way, the alarm unit 1 is diminished in useless power consumption to suppress the shortening of the life of battery as compared with the conventional alarm unit 4.

The system of the present invention is not limited to the foregoing embodiments in construction but can be modified variously by one skilled in the art without departing from the spirit of the invention as set forth in the appended claims.

Figure 8:
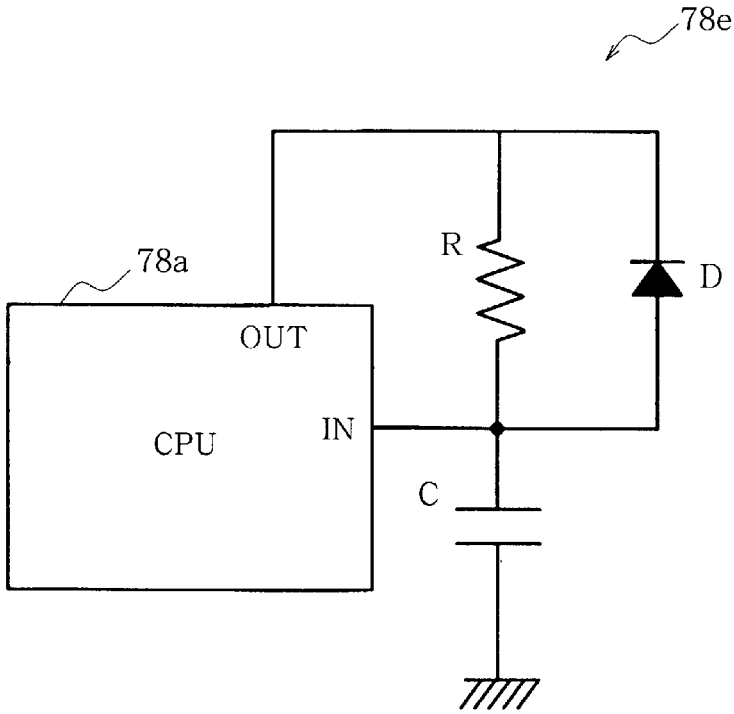
FIG. 8 is a circuit diagram showing the construction of a timer circuit of alarm unit of another embodiment.

For example, the lapse of predetermined period of time is detected with reference to the output value of the time counter 18*e* or 38*e* according to the first and second embodiments, whereas it is possible to use a time measuring circuit 78*e* shown in FIG. 8 and comprising a capacitor C and diode D, in place of the time counter. With the illustrated arrangement, a CPU 78*a* starts to operate to output a high signal representing a positive voltage from an output port upon judging that an interrupt signal is not an alarm activating signal, whereupon input of a low signal representing a low voltage to an input port of the CPU 78*a* is started. The capacitor C is thereafter gradually charged to the full, whereupon a high signal representing a high voltage is input to the input port of the CPU 78*a*. When the signal input to the input port thus changes from low to high, the CPU 78*a* detects the lapse of the predetermined period of time. The CPU 78*a* thereafter delivers a low signal representing a negative voltage from the output port to discharge the capacitor C.

Although the second embodiment is so adapted that when the signal received by the antenna 36 is not the alarm activating signal, the supply of power to the signal amplification circuit 37 is discontinued, it is possible to use an arrangement for ceasing the supply of power to the amplification circuit 37 which arrangement is also adapted to halt the clock signal supply operation of the main clock generating circuit 38*c* as in the first embodiment. Use of this arrangement results in further reduced power consumption.

What is claimed is:

1. An antitheft system comprising an alarm unit attachable to an article to be protected from theft, and a signal transmitter for transmitting an alarm activating signal to the alarm unit, the alarm unit comprising:

receiving means for receiving signals from outside, alarm means for producing an alarm in response to an alarming command, nullifying means operable in response to a nullifying command to nullify the signal received by the receiving means for a predetermined period of time subsequent to the reception of the nullifying command, and control means operable upon reception of the received signal from the receiving means to judge whether the received signal is the alarm activating signal, and give the alarming command to the alarm means when the signal is the alarm activating signal or give the nullifying command to the nullifying means when the signal is not the alarm activating signal.

2. An antitheft system according to claim 1 wherein the nullifying means of the alarm unit comprises a gate circuit interposed between the receiving means and the control means and operable in response to the nullifying command to prevent the signal received by the receiving means from passing through the gate circuit for a predetermined period of time subsequent to the reception of the nullifying command.

3. An antitheft system according to claim 1 wherein the alarm unit comprises signal processing means capable of processing as specified the signal received by the receiving means and feeding the processed signal to the control means while being supplied with electric power, and power source means for supplying electric power to the signal processing means, and the nullifying means comprises a deenergizing circuit operable in response to the nullifying command to cease the supply of electric power from the power source means to the signal processing means for a predetermined period of time subsequent to the reception of the nullifying command.

4. An antitheft system according to claim 1 wherein the control means of the alarm unit judges whether the received signal is the alarm activating signal in response to a clock signal supplied from outside, and the alarm unit further comprises clock supply means for supplying the clock signal to the control means, and a clock halting control means for ceasing the clock signal supplying operation of the clock supply means for the predetermined period of time when the received signal is not found to be the alarm activating signal.

* * * * *